US008355520B2

(12) United States Patent
Ito

(10) Patent No.: US 8,355,520 B2
(45) Date of Patent: Jan. 15, 2013

(54) MUSIC PLAYER

(75) Inventor: Masafumi Ito, Hamamatsu (JP)

(73) Assignee: Yamaha Corporation (JP)

( * ) Notice: Subject to any disclaimer, the term of this patent is extended or adjusted under 35 U.S.C. 154(b) by 1446 days.

(21) Appl. No.: 11/469,694

(22) Filed: Sep. 1, 2006

(65) Prior Publication Data

US 2007/0071256 A1 Mar. 29, 2007

(30) Foreign Application Priority Data

Sep. 1, 2005 (JP) ..... 2005-253852

(51) Int. Cl.
*H04R 1/02* (2006.01)
*H04R 9/06* (2006.01)

(52) U.S. Cl. ..... 381/334; 381/87; 381/335; 381/336; 381/77; 24/3.1; 24/3.2; 704/272

(58) Field of Classification Search ..... 381/118, 381/334, 333, 335, 336, 87, 77; 24/3.1, 3.2; 704/272; 700/94
See application file for complete search history.

(56) References Cited

U.S. PATENT DOCUMENTS 5,735,800 A 4/1998 Yasukawa et al.

FOREIGN PATENT DOCUMENTS

| | | | |
|---|---|---|---|
| JP | S51-92172 | | 1/1975 |
| JP | S59-4489 | U | 1/1984 |
| JP | S59-89285 | U | 6/1984 |
| JP | 08-299290 | A | 11/1996 |
| JP | 3038702 | A | 4/1997 |
| JP | 2001-160850 | A | 6/2001 |
| JP | 2002-58088 | A | 2/2002 |
| JP | 2002-125282 | A | 4/2002 |
| JP | 3093100 | A | 4/2003 |
| JP | 2005-040259 | A | 2/2005 |

OTHER PUBLICATIONS

Samsung Digital Audio Player Manual, Model # YP-60; AH68-01509N (Rev 0.0), Printed Jan. 14, 2005.*
"Creative MuVo Sport C100" [online], Creative Media Inc., [retrieved on Aug. 16, 2005], received from Internet <URL http://jp.creative.com/products/pfriendly.asp?product=10794>, with its English translation, accessed on Aug. 16, 2005.

(Continued)

*Primary Examiner* — Vivian Chin
*Assistant Examiner* — Paul Kim
(74) *Attorney, Agent, or Firm* — Rossi, Kimms & McDowell LLP

(57) ABSTRACT

A music player is worn on a limb of a body when in use and includes: a case; a plurality of buttons through which an instruction relating to music reproduction is given; and a band fitting portion to which a band is fittable, the band being used when the case is worn on the limb. In the music player, the case has a chamfer constituted of a plane whose line of intersection with the band is diagonal to a longitudinal direction of the band, the plural buttons are provided on an upper face of the case, an arrangement direction of the plural buttons being parallel to the plane constituting the chamfer, and the chamfer has an audio output terminal. Preferably, the chamfer has a connection terminal to which an exercise state detection sensor for detecting a state of exercise practiced by a wearer of the music player is connectable.

20 Claims, 10 Drawing Sheets

OTHER PUBLICATIONS

"Samsung Digital World-Digital Audio Player (sales terminated) YP-60V" [online], Samsung Japan Inc., [retrieved on Aug. 16, 2005], received from Internet <URL:http://www.samsung.com/jp/products/discondaplayer/discondaplayer/yp_60v.asp#> with its English translation, accessed on Aug. 16, 2005.

Office Action issued in Priority Japanese Application 2005-253852. OA mailed Apr. 12, 2011.

Notification of Reason(s) for Refusal in corresponding JP 2005-253852, dated Jul. 12, 2011. English translation provided.

* cited by examiner

５０…腕

MUSIC PLAYER

BACKGROUND OF THE INVENTION

1. Field of the Invention

The invention relates to a music player that is worn on a limb of a body via a band when in use.

2. Description of the Related Art

There has conventionally been known a portable music player, and in recent years, a music player such as an MP3 (MPEG Audio Layer-3) player that stores audio data in an internal memory provided in its main body and reproduces the stored audio data has come on the market. Such a type of music player has become so small and light-weighted that it can be worn on an arm or a leg, and is skip-free even if given slight vibration. Therefore, music players intended to be worn on a body when a user uses it during exercise have also come on the market.

For example, the following documents 1 and 2 describe such a music player.

Document 1: "Creative MuVo SPORT C100", [online], Creative Media Inc., [retrieved on Aug. 16, 2005], received from the Internet <URL: http://jp.creative.com/products/pfriendly.asp?product=10794>

Document 2: "Samsung Digital World-Digital Audio Player (sales terminated)|YP-60V", [online], Samsung Japan Inc., [retrieved on Aug. 16, 2005], received from the Internet <URL:http://www.samsung.com/jp/products/discondaplayer/discondasplayer/yp_60v.asp#>

SUMMARY OF THE INVENTION

However, conventional music players have a problem that they do not offer sufficient operability when worn on a body.

It is an object of the invention to solve such a problem, thereby improving operability of a music player worn on a body.

To attain the above object, a music player of the invention is worn on a limb of a body when in use, and includes: a case; a plurality of controls through which an instruction relating to music reproduction is given; and a band fitting portion to which a band is fittable, the band being used when the music player is worn on the limb, wherein the case has a chamfer constituted of a plane extending upward at an arbitrary angle from a face that faces the limb when the case is worn on the limb, a line of intersection between the plane and the band fitted to the band fitting portion being diagonal to a longitudinal direction of the band, wherein the plural controls are provided on a face, of the case, opposite the face facing the limb, an arrangement direction of the plural controls being parallel to the plane constituting the chamfer, and wherein the chamfer has an audio output terminal.

In such a music player, it is preferable that the chamfer has a connection terminal to which an exercise state detection sensor for detecting a state of exercise practiced by a wearer of the music player is connectable.

It is preferable that an arrangement direction of characters written on the face of the case matches the arrangement direction of the controls.

It is also preferable that the band fitting portion allows the band to be fitted to the case selectively in two orthogonal directions, and the line of intersection of the plane constituting the chamfer and the band is diagonal to the longitudinal direction of the band in whichever direction of the two directions the band is fitted.

It is also preferable that the band fitting portion is attachable/detachable to/from the case.

It is also preferable that the case is a flat case.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, the best mode for carrying out the invention will be concretely described based on the drawings.

Embodiment

FIG. 1 to FIG. 11

First, one embodiment of a music player of the invention will be described.

Figure 1:
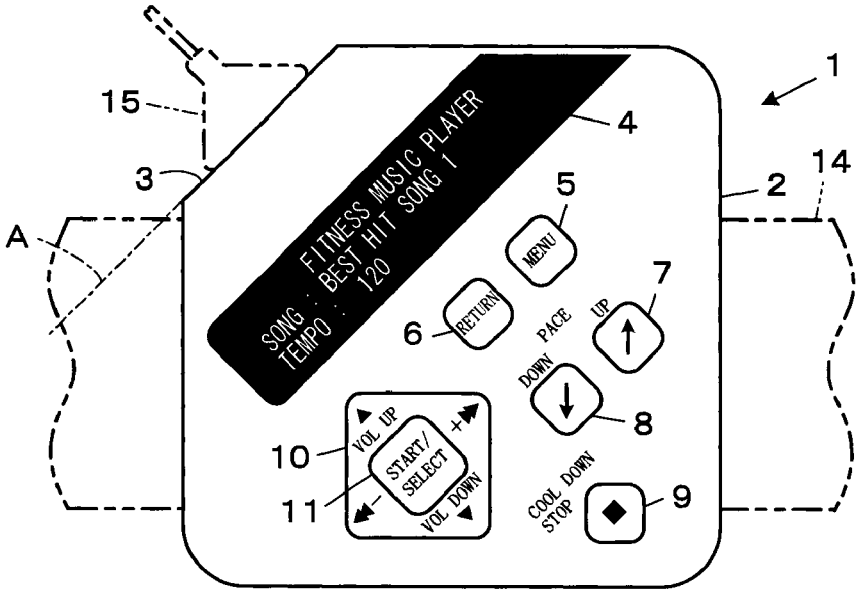
FIG. 1 is a top view of a music player being an embodiment of the invention.

FIG. 1 is a top view of the music player.

A music player 1 reproduces and outputs music based on automatic performance data, audio data, and the like stored in an internal memory. As shown in FIG. 1, as its exterior, the music player 1 has a case 2, and on an upper face thereof, a display portion 4 and various buttons 5 to 11 are provided.

The case 2 is in a flat and substantially cuboid shape with rounded corners, and has, on the upper left side in FIG. 1, a chamfer 3 that is constituted of a plane perpendicular to the upper face and a bottom face of the case 2 and making a 45 degree angle relative to a side face of the case 2.

The display portion 4 includes a liquid crystal display (LCD) and is a display for displaying, for instance, information relating to the contents of the operation of the music player 1 such as a message to a user, and a title and a reproduction tempo of music being reproduced. The display part 4 is disposed in a manner such that an arrangement direction of characters displayed thereon is parallel to the chamfer 3.

The menu button 5 accepts an instruction for displaying a hierarchical menu for various settings such as an operation mode, an exercise target, message display, and necessity of sound effect.

The return button 6 accepts an instruction for returning to an upper layer in the menu, an instruction for canceling the setting, and the like.

The pace-up button 7 and the pace-down button 8 accept an instruction for speeding up/down the tempo of reproduced music.

The stop button 9 accepts an instruction for stopping music reproduction and an instruction for shifting to a cool-down mode.

The multifunction button 10 accepts instructions for volume increase/decrease of reproduced music, selection of a musical composition to be reproduced, roll-up/down of the menu, and the like.

The start button 11 accepts an instruction for starting music reproduction, a determination instruction in the menu, and so on.

These buttons are arranged in a plurality of arrays parallel to the plane constituting the chamfer 3. Further, characters briefly describing functions of the buttons are written near the buttons or on the buttons, and the arrangement direction of these characters is also parallel to the plane constituting the chamfer 3.

Figure 2:
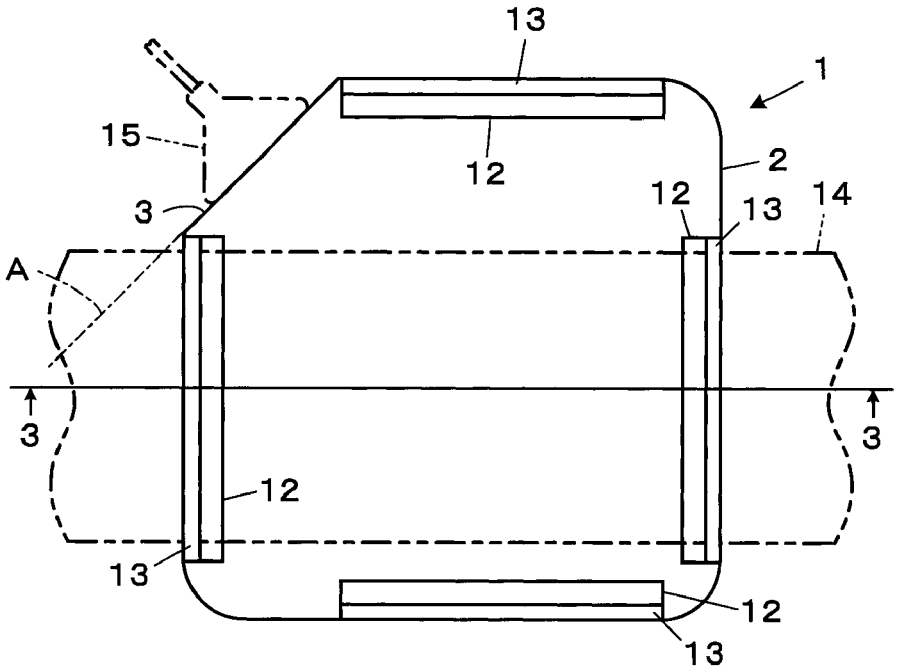
FIG. 2 is a bottom view of the music player.
Figure 3:
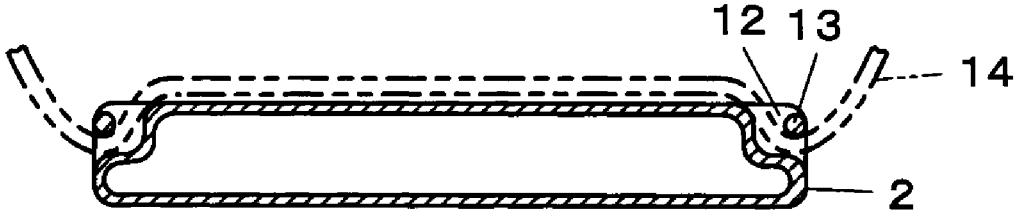
FIG. 3 is an end view taken along the 3-3 line in FIG. 2.

FIG. 2 shows a bottom view of the musical player 1 and FIG. 3 shows a cross-sectional view taken along the 3-3 line in FIG. 2. In FIG. 3, the internal structure of the music player 1, the controls on the upper face (lower side in FIG. 3), and so on are omitted.

As shown in these drawings, band fitting portions 14 for having a band 14 fitted thereto and band stopper bars 13 for stopping the band 14 are provided on the bottom face of the music player 1, the band 14 being used when the music player 1 is worn on a limb.

Each of the band fitting portions 12 is made by cutting part of an end portion of the case 2, and as shown in FIG. 3, in the two band fitting portions 12, the band 14 is inserted between the columnar band stopper bars 13 and the case 2, whereby the band 14 can be slidably fitted to the case 2. Therefore, the bottom face side faces the limb when the music player 1 is worn on the limb.

On the bottom face of the case 2, two pairs of the band fitting portions 12 are provided along four sides so that the band 14 can be fitted in a desired direction out of two orthogonal directions, namely, a vertical direction and a lateral direction in FIG. 2. The band 14 is a band-shaped member made of an arbitrary material, and when the music player 1 is worn on a limb, an appropriate position of the band 14 is fixed by a not-shown fixing member such as a buckle, whereby the band 14 can be looped.

Here, in whichever direction the band 14 is fitted, a line A of intersection between the plane constituting the chamfer 3 and the band 14 makes a 45 degree angle relative to a longitudinal direction of the band 14.

Figure 4:
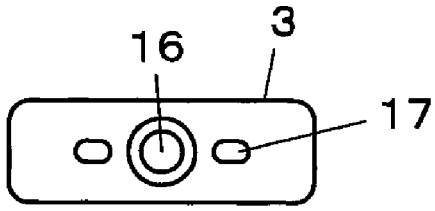
FIG. 4 is a front view of a chamfer of the music player shown in FIG. 1.

FIG. 4 shows a front view of the chamfer 3 of the music player 1. In FIG. 4, portions except the chamfer 3 are not shown.

As shown in FIG. 4, the chamfer 3 has an audio output terminal 16 to which an audio output device is connectable and a sensor terminal 17 to which an exercise state detection sensor detecting a state of exercise practiced by a wearer is connectable.

Here, to these terminals, a headphone is connectable as the audio output device, and a pulse sensor worn on an ear of a wearer to detect a pulse of the wearer is connectable as the exercise state detection sensor. FIG. 2 shows a state where a plug 15 (shown by the virtual line) of the headphone (denoted by the reference numeral 18 in FIG. 5) integrally structured with the pulse sensor is connected to the audio output terminal 16 and the sensor terminal 17. Alternatively, one terminal may serve the functions of the audio output terminal 16 and the sensor terminal 17.

Figure 5:
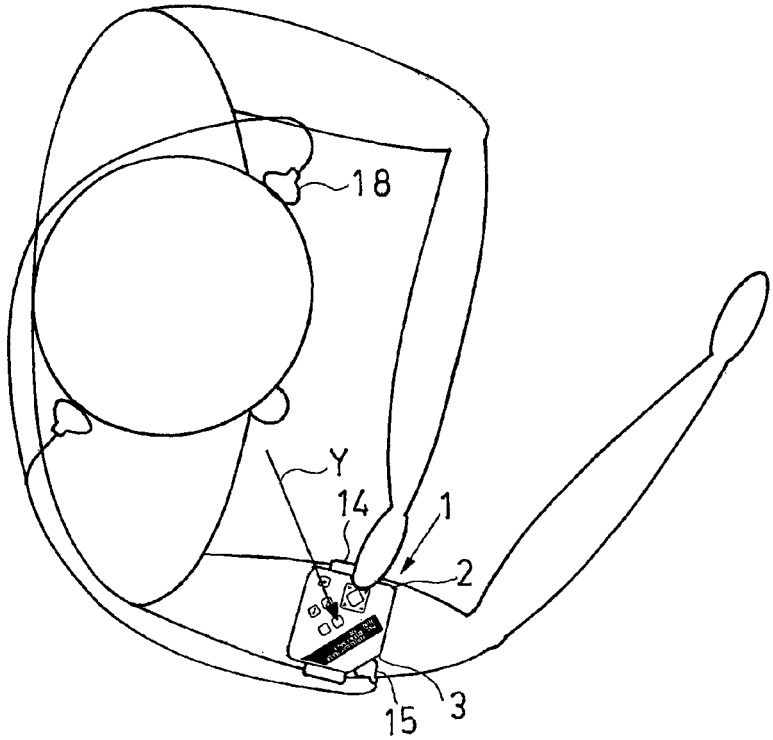
FIG. 5 is a view showing a state where the music player is worn on a left arm for use.
Figure 6:
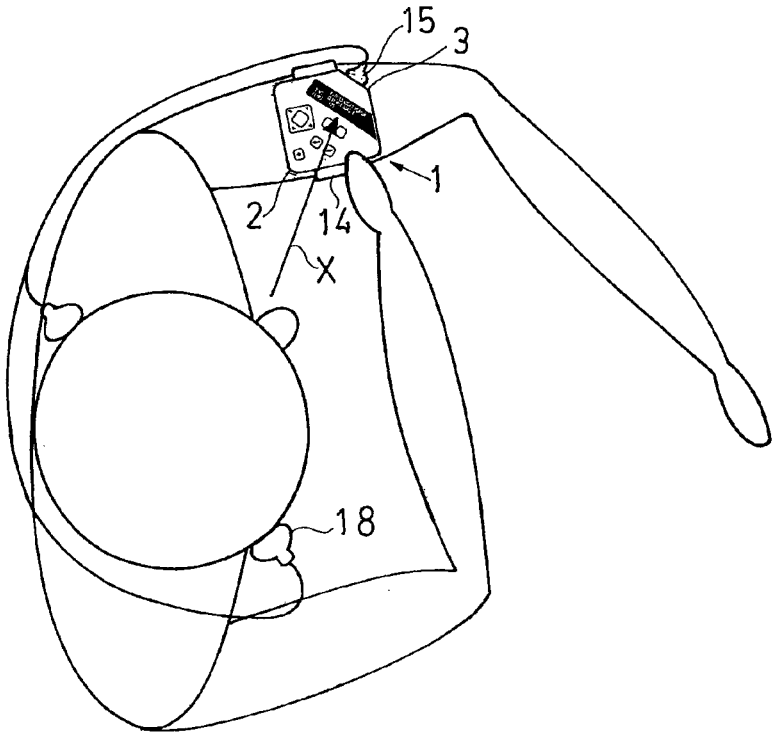
FIG. 6 is a view showing a state where the music player is worn on a right arm for use.

Next, FIG. 5 and FIG. 6 show a state where the music player 1 is in use. FIG. 5 and FIG. 6 show states where a person wears the music player 1 on the arm and wears the headphone 18 connected to the music player 1 on the head, and in this state, the person is operating the controls on the music player 1.

The music player 1 described above is structured to offer high operability when worn on a limb, especially on an arm out of the four limbs, more specifically, on an upper arm, via the band 14 for use.

First, to wear the music player 1 on the left arm for use, the band 14 is fitted to the case 2 in the direction shown by the virtual line in FIG. 2 (lateral direction). Then, the music player 1 is worn on the left arm via the band 14 with the chamfer 3 being on an outer side. FIG. 5 shows this state.

Specifically, the controls are arranged on the case 2 diagonally to the band 14, and accordingly, in the state where the music player 1 is worn on the arm, an arrangement direction of the controls become diagonal to a line of the arm on which the music player 1 is worn. When the wearer slightly lifts the arm on which the music player 1 is worn so as to be capable of easily operate the controls, the controls face the wearer's face and the arrangement direction thereof becomes substantially perpendicular to a line X of sight, and thus, such an arrangement direction of the controls allows the wearer to easily operate the controls with the other arm while seeing the controls.

Further, the characters on the case 2 and the characters displayed on the display part 4 are also arranged diagonally to the band 14, and therefore, in the state where the music player 1 is worn on the arm, the characters also face the wearer's face and the arrangement direction thereof becomes substantially perpendicular to the line X of sight, so that the characters can be easily read.

To wear the music player 1 on the right arm for use, the band 14 is fitted to the case 2 in the vertical direction in FIG. 2. Then, the music player 1 is worn on the right arm via the band 14 with the chamfer 3 being on an outer side. This state is shown in FIG. 6.

Also in this case, in the state where the music player 1 is worn on the arm, the controls and the characters face the wearer's face and the arrangement direction thereof becomes substantially perpendicular to a line Y of sight, so that the controls are easily operated with the other arm and the characters are also easily readable.

On the other hand, for example, if the controls and the characters are arranged in the same direction as or in the perpendicular direction to the band, the arrangement direction of the controls and the characters is perpendicular or parallel to the line of the arm in the state where the music player 1 is worn on the arm. However, in a state where the wearer slightly lifts the arm on which the music player 1 is worn so that he can easily operate the controls, it is difficult to make the line of sight parallel or perpendicular to the line of the arm. Therefore, if the controls and the characters are arranged in the same direction as or in the perpendicular direction to the direction of the band, the wearer wearing the music player 1 on his arm has a difficulty in operating the controls while seeing them.

Therefore, it can be said that arranging the controls and the characters diagonally to the band 14 makes it possible to improve operability of the music player 1 worn on the arm. Moreover, since the direction of the band 14 is selectable from the two orthogonal directions, high operability can be obtained on whichever one of the right and left arms the music player 1 is worn.

Further, since the case 2 has the chamfer 3, and the audio output terminal 16 and the sensor terminal 17 are provided on the chamfer 3, it is possible to prevent the plug 15 connected to the terminals from protruding to the outside of the case 2, compared with a case where the case 2 does not have the chamfer 3. This can reduce a danger of direct collision of the plug 15 with an object or a person even if the arm collides with the object or the person during exercise, and can prevent the plug 15 from coming off the terminals 16, 17 or the plugs 15 and the terminals 16, 17 from breaking, due to a shock accompanying the collision.

Incidentally, in the example described here, the plane constituting the chamfer 3 extends upright from the bottom face of the case 2 and makes a 45 degree angle relative to the longitudinal direction of the band 14, but it should be noted that this is not restrictive. For example, the angle at which this plane extends upward from the bottom face of the case 2 may be any angle such as 45 degrees or 60 degrees. In addition, the angle between the line A of intersection shown in FIG. 2 and the longitudinal direction of the band 14 may also be any angle providing that the line A of intersection is diagonal to the band 14. However, if this angle is set close to 45 degrees, specifically, about 30 degrees to about 60 degrees, operability when the music player 1 is worn on the right arm and operability when it is worn on the left arm can be made more uniform.

Further, here, the band 14 is attachable/detachable to/from the case 2 and is fittable selectively in the two orthogonal directions, but the band 14 may be fixed to the case 2 if good operability is needed only when the music player 1 is worn on one of the arms. Further, here, the band 14 is formed in one band shape, but may be in a shape having two divided portions.

Further, here, the example where the music player 1 is worn on the upper arm is described, but the same effects can be obtained also when the music player 1 is worn on a forearm or a leg. That is, the controls can be arranged in a direction so that the wearer wearing the music player 1 on his arm or leg can easily operate them by stretching the other arm while seeing the controls.

For example, in a case where the music player 1 is worn on a thigh or an ankle, it is thought that the wearer naturally bends forward to operate the controls, and in this state, it is thought that the line of vision also becomes diagonal to the band 14. Further, for example, when the wearer practices abdominal sit-up exercises, the arms are folded behind the head, and therefore, it is thought that in some cases, wearing the music player 1 on a leg more facilitates seeing and operating the controls than wearing it on the arm.

Next, the configuration for the music player 1 to reproduce music will be described.

Figure 7:
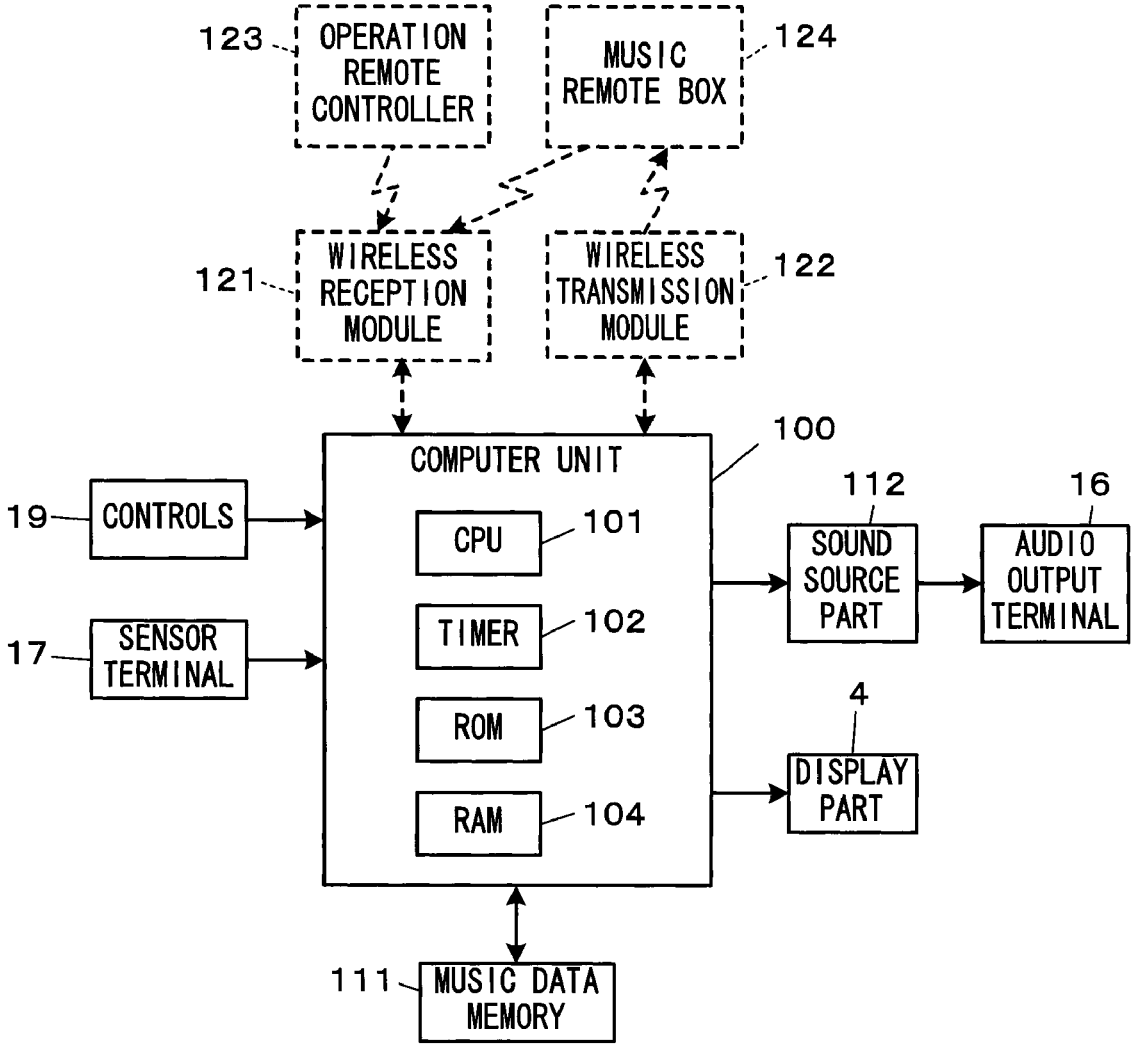
FIG. 7 is a diagram showing the configuration of an electrical control section of the music player shown in FIG. 1.

First, FIG. 7 shows the configuration of an electrical control section, which is used for music reproduction, of the music player 1.

As shown in FIG. 7, as the electrical control section, the music player 1 includes a computer unit 100, to which controls 19 (the buttons 5 to 11 shown in FIG. 11), the sensor terminal 17, a music data memory 111, a sound source module 112 are connected via an appropriate interface not shown. This connection may be wired or may be wireless. Batteries for supplying power to the respective parts are not shown.

The computer unit 100 is constituted as a microcomputer including a CPU 101, a timer 102, a ROM 103, and a RAM 104. The CPU 101, which is a main controller, executes control programs stored in the ROM 103 being a nonvolatile memory, thereby being capable of controlling various operations such as music reproduction based on music data, detection of a pulse of a wearer by the pulse sensor connected to the sensor terminal 17, change of the setting and operation contents according to the operation of the controls 19, display of a message on the display part 4, and so on. The ROM 103 may be a rewritable storage such as a flash memory so as to enable updating of the control programs. The timer 102 times automatic performance executed by the sound source module 112, and so on. The RAM 104 is used as a work area by the CPU 101.

The music data memory 111 is a memory constituted by a nonvolatile memory such as an EEPROM or a flash memory, and stores various data including music data for reproducing music. Concrete examples of the data are MIDI performance data, rhythm data indicating rhythm patterns, waveform data in an MP3 format or an audio format, or the like. Here, an example where the MIDI performance data is used will be described.

The MIDI performance data is data in a format such that an event for setting pitch, volume, tone, and the like of sound whose generation is to be started or stopped in each part is stored in response to each tempo clock of 48 clocks per beat. Automatic performance (music reproduction) based on the performance data can be realized in such a manner that a counter counts the number of the tempo clocks, an event corresponding to each timing is supplied to the sound source module 112 at each timing, and sound generation is controlled according to the event. Then, the sound source module 112 generates waveform data according to the event to output the waveform data to the audio output terminal 16, and a sound generating device such as a speaker of the headphone connected to the audio output terminal 16 generates sound based on the waveform data.

At this time, the sound, regardless of sound of a melody part or sound of a rhythm part, can be generated in the same manner. Therefore, there can be a musical composition consisting only of rhythm parts. Alternatively, melody parts and rhythm parts may be stored as a plurality of separate performance data and they may be combined in a desired manner for automatic performance.

Further, at the time of automatic performance, the timing for start and stop of the sound generation is determined based on the number of counts of the tempo clocks, and therefore, by changing the cycle of the tempo clocks, it is possible to change the tempo of the automatic performance. A standard tempo is set for each musical composition, but as described above, it is possible to change the tempo by changing the cycle of the tempo clocks.

It is preferable that, a large number of data regarding musical compositions and rhythms at various tempos of various genres are stored in the music data memory 111.

Incidentally, as shown in the broken lines, another possible configuration is that a wireless reception module 121 and a wireless transmission module 122 for wireless communication with external apparatuses are provided, and the wireless reception module 121 receives an operation instruction from an external operation remote controller 123 and the wireless transmission module 122 transmits an event for automatic performance or waveform data to an external music remote box 124 provided with a sound source module and a sound system so as to cause the external music remote box 124 generate sound. In such a case, it is not necessary to provide the controls 19, the display portion 4, the sound source module 112, and the audio output terminal 16 on the music player 1 side.

Incidentally, the above-described computer unit 100 detects a heart rate of a wearer based on an output of the pulse sensor connected to the sensor terminal 17 and controls automatic performance according to a detected value of the heart rate, thereby outputting a musical composition suitable for the state of exercises practiced by the wearer.

Next, processes executed by the CPU 101 for this purpose will be described.

Figure 8:
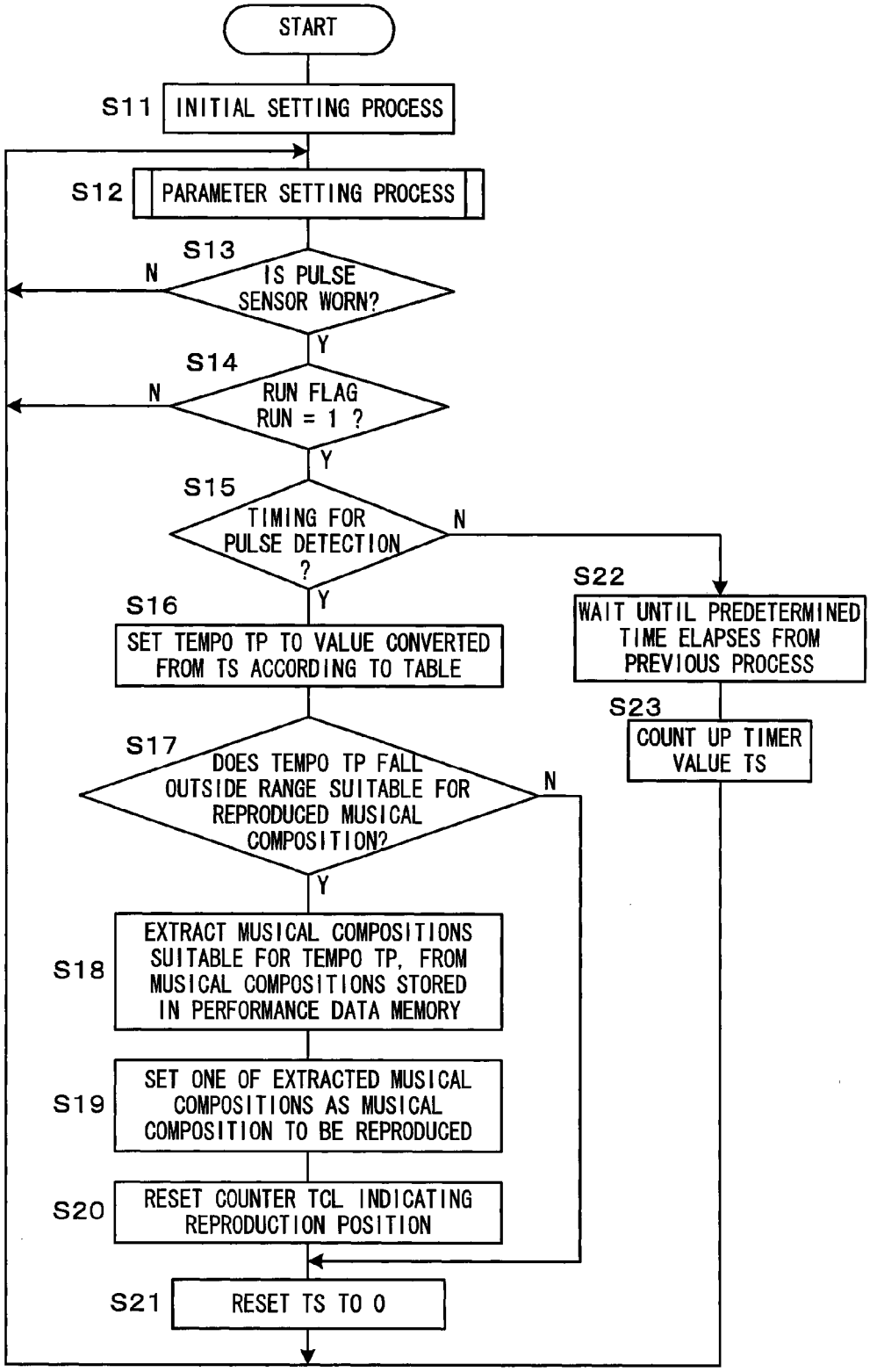
FIG. 8 is a flowchart of a main control processing of control executed by a CPU shown in FIG. 7.

First, FIG. 8 shows a flowchart of a main control processing executed by the CPU 101. Here, processes relating to control over the display by the display portion 4 are omitted.

Upon power-on of the music player 1 by a not-shown power supply switch, the CPU 101 starts the processing shown in the flowchart in FIG. 8. Then, after a predetermined initial setting process is executed (S11), a parameter setting process for setting values of various parameters according to the operation of the controls 19 is executed (S12).

Figure 9:
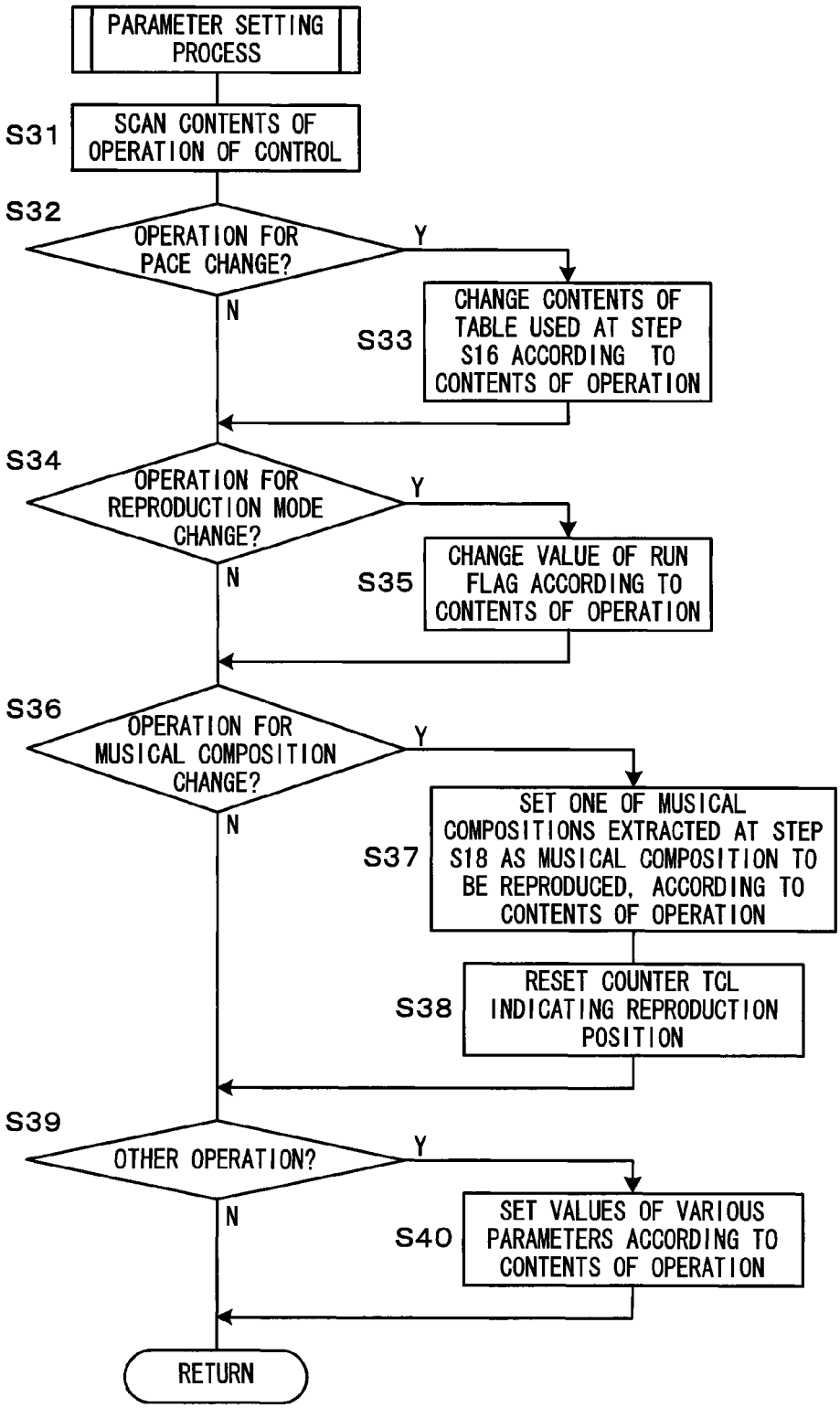
FIG. 9 is a flowchart of a parameter setting process shown in FIG. 8.

FIG. 9 shows a flowchart of the parameter setting process.

As shown in FIG. 9, in the parameter setting process, the contents of the operation of the controls 19 are first scanned (S31), and thereafter, a process according to the operation detected by the scanning is executed.

Specifically, if the pace-up button 7 or the pace-down button 8 is operated for a change of the pace (S32), the contents of a table used at Step S16 to be described later are changed according to the contents of the operation. This change is preferably about 5% change in tempo per one button operation. Further, instead of changing the contents of the table, it is also possible to change a value of an adjustment variable being a variable by which a found tempo is multiplied or which is added/subtracted to/from the found tempo.

If a change of a reproduction mode is instructed through the stop button 9 or the start button 11 (S34), a value of a run flag indicating the reproduction mode is changed according the contents of the operation (S35). Here, the run flag can take values of "1" indicating a normal reproduction mode, "2" indicating a cool-down mode, and "0" indicating a stop state. Then, if the start button 11 is pressed in the stop state, the stop state shifts to the normal reproduction mode. In the normal reproduction mode or the cool-down mode, if the stop button 9 is pressed, the reproduction mode is changed between these modes by a toggle, and if the stop button 9 is continuously pressed twice within a predetermined time, the reproduction mode shifts to the stop state.

If the multifunction button 10 is operated for a change of a musical composition (S36), musical compositions are scanned forward or backward according to the contents of the operation and one of musical compositions which have been extracted at later-described Step S18 is set as a musical composition to be reproduced (S37) and a counter TCL indicating the reproduction position of a musical composition is reset (S38). Incidentally, a musical composition or a list of musical compositions to be reproduced first is set in advance in the initial setting process (S11), and this is used until the process at Step S18 is executed.

Further, if other operations are performed, values of various parameters are also changed according to the contents of the operation (S39, S40). This process includes selecting a musical composition to be reproduced and an operation mode by using the menu.

After the above processes, the flow returns to the original process, namely, a process at Step S13 in FIG. 8.

Then, based on a detection result by the pulse sensor, it is determined whether or not a user wears the pulse sensor (S13). If YES here and the value of the run flag RUN is "1" indicating the normal reproduction mode (S14), processes at and after Step S15, namely, processes for measuring a heart rate, and setting a tempo and selecting a musical composition according to the measurement of the heart rate are executed.

In these processes, it is first determined based on the output of the pulse sensor whether or not a pulse of the wearer has reached a predetermined phase defined as the measurement timing (for example, the timing at which a blood pressure reaches the maximum or minimum value) (S15). Incidentally, the measurement timing may be set once per plural pulse beats instead of per one pulse beat. If the current timing is not the measurement timing, the flow waits until a predetermined time, for example, two milliseconds, elapses from the previous process (S22). Then, a timer value TS is thereafter counted up (S23), and the flow returns to Step S12. That is, the timer value TS is counted up every predetermined time until the current timing becomes the measurement timing. Incidentally, when reaching a predetermined count value, the timer value TS may be made to overflow to return to 0.

On the other hand, if the current timing is the measurement timing, a tempo TP of music reproduction is set to a value converted from the timer value TS according to the table (S16). At this instant, the timer value TS should be a value proportional to the time from the previous measurement timing to the current measurement timing, that is, an interval of the pulse beats of the wearer, and therefore, by this process, it is possible to determine the tempo TP of the music reproduction based on the pulse of the wearer. In other words, it is possible to detect the state of exercise of the wearer based on a change in pulse and determine the tempo TP based on this state.

A possible way of the conversion is such that the tempo TP is set equal to or proportional to the pulse rate. Another possible setting is that, if the pulse rate exceeds a predetermined threshold value such as a value indicating a range suitable for aerobic exercise or a value set by the user, the tempo TP is not made higher or conversely, the tempo TP is made lower even when the pulse rate increases. Of course, other relation is also conceivable. Further, a plurality of tables are prepared here with different low to high overall tempos being set in the respective tables, and a table for use in the process at Step S33 in FIG. 9 is changed, whereby the tempo of music reproduction can be changed.

Thereafter, it is determined whether or not the tempo TP set at Step S16 falls outside the range suitable for the musical composition which are being reproduced (S17). The suitable range can be given by, for example, the following expression, where MOD ( ) represents a remainder of the expression in the parenthesis $$\{S+10-\mathrm{MOD}(S/10)\} \geqq TP \geqq \{S-\mathrm{MOD}(S/10)\}$$

If the current tempo TP satisfies the above expression with respect to a standard tempo S of the musical composition being reproduced, it can be determined that the tempo TP is suitable. For example, in a case of S=118, the tempo TP is determined as suitable if its value falls within a range from 110 to 120. Besides, $|TP-S| \leqq 5$ or the like may be used as a criterion. Other criterion is of course usable.

Then, if the tempo TP falls outside the suitable range, musical compositions suitable for the tempo TP are extracted as selection candidates from the musical compositions stored in the music data memory 111 in order to re-select a musical composition suitable for the tempo TP (S18), and one of the extracted musical compositions is set as a musical composition to be reproduced (S19). Since the musical composition set here can be changed later, any appropriate criterion may be used here for setting the musical composition to be reproduced, for example, a musical composition whose storage address in the memory is the youngest may be selected.

Thereafter, after the counter TCL indicating the reproduction position is reset (S20) and the timer value TS is also reset (S21), the flow returns to Step S12 and the processes are repeated.

On the other hand, if NO at Step S17, the flow directly goes to Step S21 and subsequent processes are executed.

If NO at Step S13, the pulse cannot be detected, and if NO at Step S14, the setting of the tempo TP based on the detection result of the pulse sensor is not performed, and therefore, the flow directly returns to Step S12, and the processes are repeated.

Through the above processes, the CPU 101 is capable of continuously detecting the state of the exercise practiced by the wearer based on the output of the pulse sensor connected to the sensor terminal 17, and is capable of setting the tempo of a reproduced musical composition based on the detected state.

Figure 10:
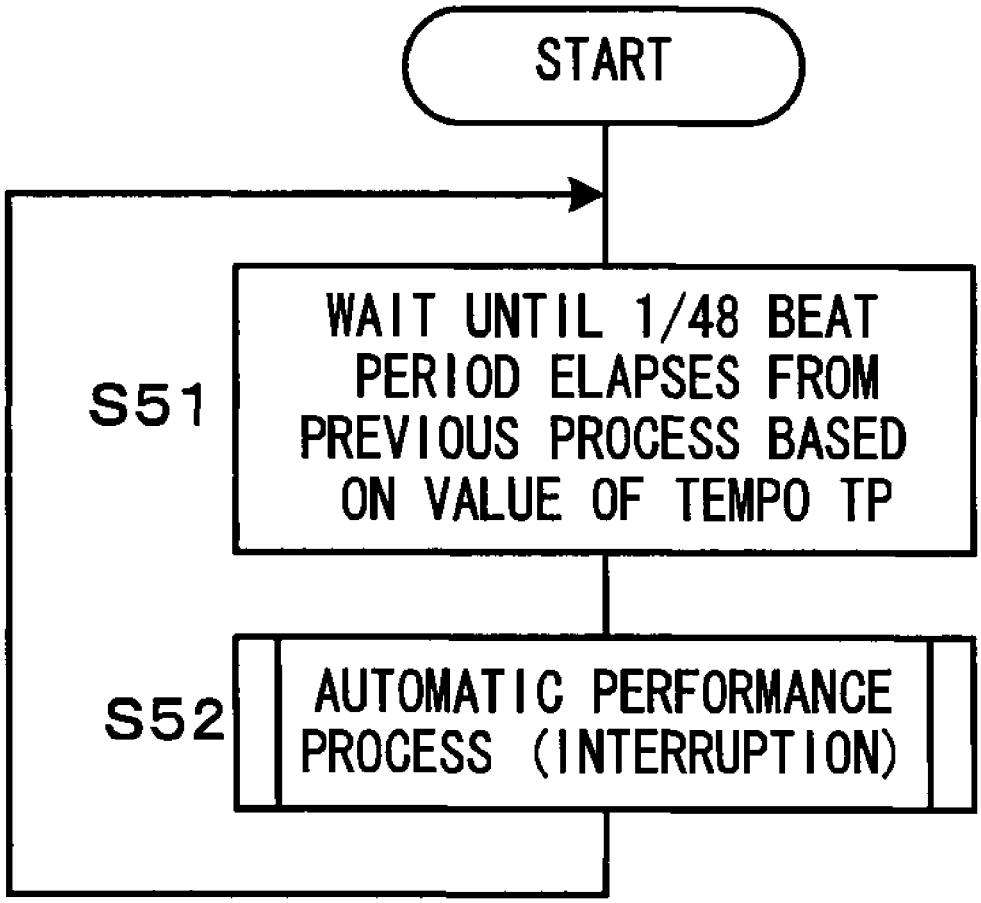
FIG. 10 is a flowchart of a performance timing adjustment process executed by the CPU shown in FIG. 7.
Figure 11:
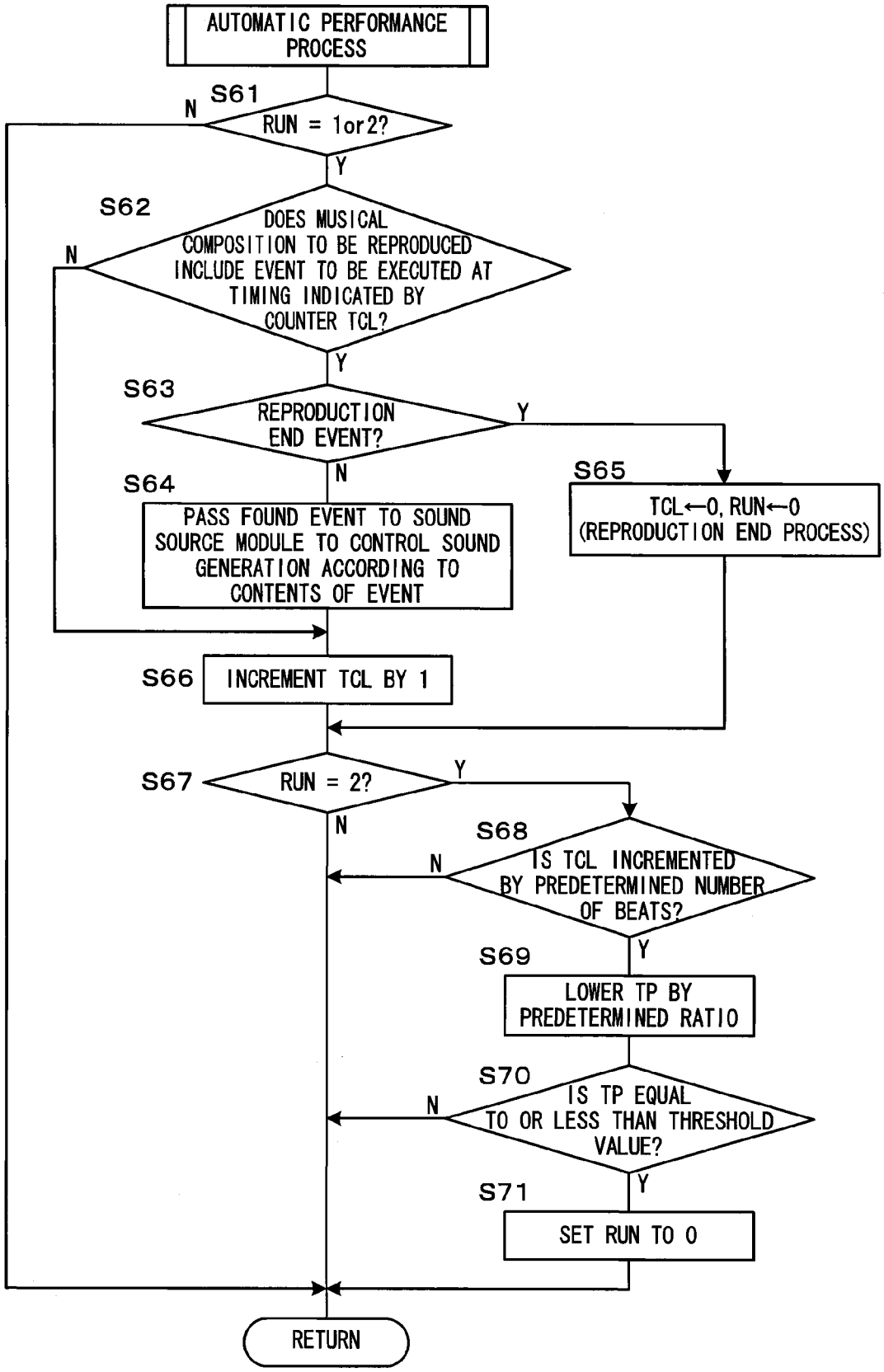
FIG. 11 is a flowchart of an automatic performance process shown in FIG. 10.

Next, FIG. 10 and FIG. 11 show flowcharts of processes relating to automatic performance.

When the music player 1 is turned on and a predetermined initialization process is finished, the CPU 101 starts a performance timing adjustment process shown in FIG. 10 and thereafter, while continuing this process, the CPU 101 inserts an interruption every ¼s beat period based on the value of the tempo TP to execute an automatic performance process (S51, S52). The interruption cycle is changed in accordance with a change in the tempo TP, and while the TP is set to 0, the cycle may be set infinite so as not allow the occurrence of the interruption.

The contents of the automatic performance process are shown in the flowchart in FIG. 11. First, if the value of the run flag RUN is neither "1" nor "2" (S61), the value of the run flag RUN is "0", which means that the current state is the stop state, and therefore, the process is terminated. On the other hand, if the value of the run flag RUN is "1" or "2", performance data of a musical composition to be reproduced is referred to, and it is determined whether or not the performance data includes an event that should be executed at a timing corresponding to a count value of the counter TCL (its initial value is 0) indicating the progress status of the reproduction (S62).

Here, if such an event exists and this event is not a reproduction end event indicating the end of the musical composition, the determination at Step S63 results in NO, and the found event is passed to the sound source module 112 and sound generation is controlled according to the contents of the event (S64). Then, the counter TCL is incremented by one (S66), and the flow goes to Step S67, and thereafter processes relating to tempo setting in the cool-down mode are executed.

On the other hand, if NO at Step S62, the counter TCL is simply incremented by one (S66), and the subsequent processes are executed. If YES at Step S63, the counter TCL and the run flag RUN are both reset to 0 (S65), and the flow goes to Step S67. Incidentally, another possible process is to keep the value of the run flag RUN unchanged and reproduce the same musical composition again from the head, or to change a reproduced musical composition to a next candidate among the musical compositions extracted at Step S18 in FIG. 8, reset the counter TCL and successively reproduce the next musical composition.

Through the above-described processes, the CPU 101 is capable of executing automatic performance of a musical composition to be reproduced at the tempo set at Step S16 in FIG. 8. That is, the CPU 101 can change the music reproduction speed in association with the pulse of the wearer, and as a result, can change the music reproduction speed in association with the state of exercise practiced by the wearer.

Further, in the processes at and after Step S67, if the value of the run flag RUN is not "2" (S67), no adjustment of the tempo TP is needed, and therefore, the flow directly returns to the original process, and on the other hand, if the value of the run flag RUN is "2" and the counter TCL has been incremented by a predetermined number of beats (S68), the tempo TP is lowered by a predetermined ratio (S69). Otherwise, the flow directly returns to the original process. The predetermined number of beats may correspond to, for example, one whole note (four beats in a case of quadruple rhythm), and the predetermined ratio may be, for example, 5%.

Then, after Step S69, if the tempo TP has become equal to or lower than the predetermined threshold value (S70), the value of the run flag RUN is set to "0" to stop the reproduction of the music (S71), and the flow returns to the original process.

By this portion of the processes, in the cool-down mode, it is possible to lower the reproduction tempo every predetermined number of beats, and accordingly, the tempo of the exercise can be gradually lowered for cool down.

Incidentally, at an instant when the value of the run flag RUN changes from "1" to "2", the first tempo reduction may immediately take place.

In the music player 1, the processes as described hitherto are executed, so that a wearer of the music player 1 can practice exercise while listening to music reproduced at a tempo suitable for the state of the exercise, and thus can enjoyably practice the exercise. This can motivate the wearer's intention to continue the exercise, so that the results of enhanced physical function, obesity prevention, and the like owing to the exercise can be easily realized.

Moreover, owing to the changeability of the kind of reproduced music (title and genre such as pop music and classic music), the reproduced music does not become monotonous and is not tiring. Further, when the tempo changed according to the state of exercise (here, the heart rate) becomes unsuitable for a reproduced musical composition, the kind of music is automatically changed according to the state of the exercise, for example, a slow-tempo musical composition such as ballad is changed to a high-tempo musical composition such as samba or bossa nova. This can prevent a great change of the tempo of music from the original tempo of the music and thus can prevent a feeling of strangeness. In this respect, reproduced music does not become monotonous, so that the wearer can enjoy exercise while listening to music full of variety.

Here, the pulse of the wearer detected by the pulse sensor is used as information indicating the state of exercise practiced by the wearer. However, instead of or in addition to the pulse, an acceleration of the arm, leg, head of the wearer, an exercise machine used by the wearer, or the like may be detected by an internal or external acceleration sensor, and the detected acceleration may be used as the information indicating the state of exercise of the wearer. Especially in a case where the wearer is practicing exercise such as jogging, cycling, or the like involving cyclic motions, it is also effective to detect the cycle of the exercise and time the tempo of reproduced music to the detected cycle.

Modification Examples

FIG. 12 to FIG. 15

The embodiment described above is only an example of the invention and various modifications can be made. Next, modification examples of the above-described embodiment will be described.

First, a band fitting portion may be provided as a supporter attachable/detachable to/from a case, though the band fitting portion 12 in the above-described embodiment is provided in the case 2 itself.

Figure 12:
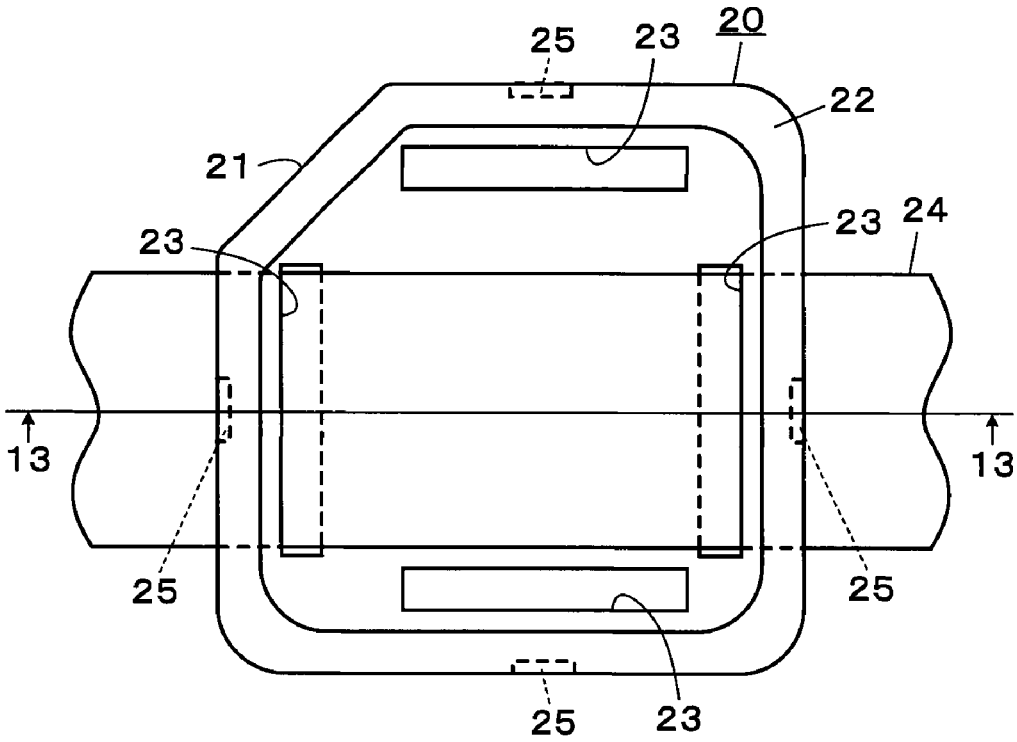
FIG. 12 is a top view of a supporter provided in a modification example of the invention.
Figure 13:
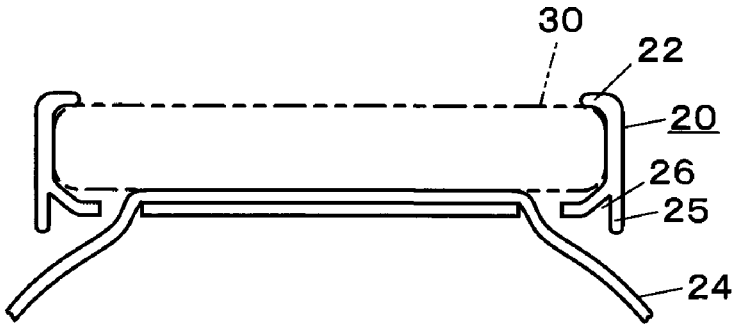
FIG. 13 is a cross-sectional view taken along the 13-13 line in FIG. 12.

FIG. 12 is a top view showing a structural example of such a supporter. FIG. 13 is a cross-sectional view taken along the 13-13 line in FIG. 12.

As seen in FIG. 12 and FIG. 13, the supporter 20 has an outer shape slightly larger than a case 30 of a music player and has a size and a shape allowing the case 30 to be fittingly housed therein. Further, the case 30 housed inside the supporter 20 does not have the band fitting portion 12. The other structure of the case 30 is the same as that of the case 2 shown in FIG. 1, and the case 30 also has a chamfer similar to that of the case 2. Accordingly, the supporter 20 also has a chamfer facing portion 21 corresponding to the chamfer, and a through hole is provided in this portion so that an audio output terminal and a sensor terminal are exposed to the outside therefrom.

The supporter 20 is made of a material somewhat deformable and restorable to an original shape such as rubber or silicon resin. The case 30 can be fixed inside the supporter 20 in such a manner that a case fixing portion 22 on an upper face of the supporter 20 is pushed outward and the case 30 is inserted therein, and thereafter, the supporter 20 is returned to the original shape.

Further, as shown in FIG. 12, the supporter 20 has two pairs of through holes 23 for having a band 24 inserted therethrough, so that the band 24 can be fitted selectively in two orthogonal directions. Then, by using the band 24, the supporter 20 and the case 30 via the supporter 20 are fitted to a limb of a wearer, whereby the music player can be wholly worn on the limb of the wearer.

Further, the supporter 20 has, on four sides thereof, hooks 25 protruding downward, so that a cord housing portion 26 is formed between the hooks 25 and a main body of the supporter 20. Therefore, a cord of a headphone or the like connected to the audio output terminal can be housed in the cord housing portion 26 by being wounded around an end portion of a bottom face of the supporter 20.

The structure described above can also provide the same effects as those of the above-described embodiment. In addition, the wearer can attach/detach the band 24 to/from the case 30 only by inserting/detaching the case 30 into/from the supporter 20, without troublesome work of inserting the band 24 through the through holes. This can enhance convenience in such a case where, in using the music player, a user wears the music player on a limb at one time and does not wear it at another time.

It should be noted that the structure of the supporter is not limited to that shown in FIG. 12 and FIG. 13.

Figure 14:
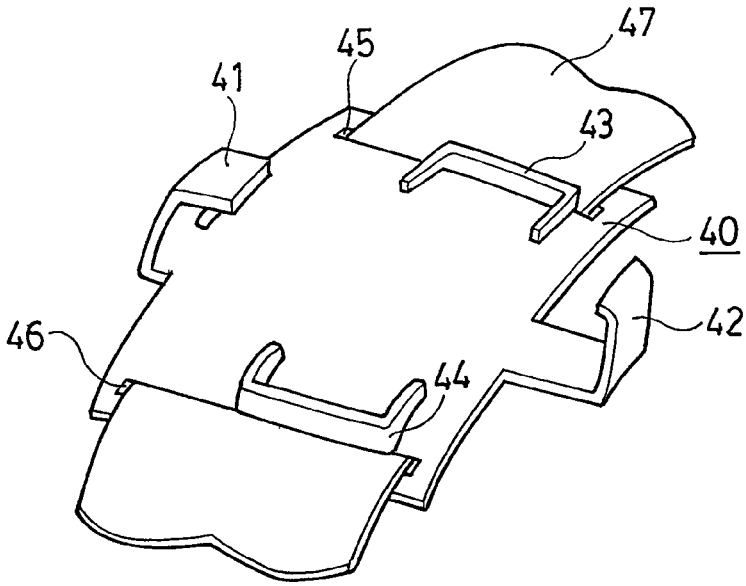
FIG. 14 is a perspective view showing another configuration example of the supporter.

FIG. 14 shows another structural example of the supporter.

A supporter 40 has a first and a second elastic claw 41, 42. One side of a case 30 similar to the above-described case 30 is first engaged with the claw 41, and thereafter, the case 30 is pushed down toward a supporter main body side while the second claw 42 is pushed slightly outward, so that the case 30 can be fixed by being sandwiched between the first and second claws 41, 42. At this time, a pair of support portions 43, 44 support the case 30 from under.

The supporter 40 has a pair of through holes 45, 46 for having a band 47 inserted therethrough, whereby the band 47 can be fitted to the supporter 40. By using this band 47, it is possible for a wearer to wear the supporter 40 and the case 30 via the supporter 40 on a limb and to wholly wear the music player on the limb.

Figure 15:
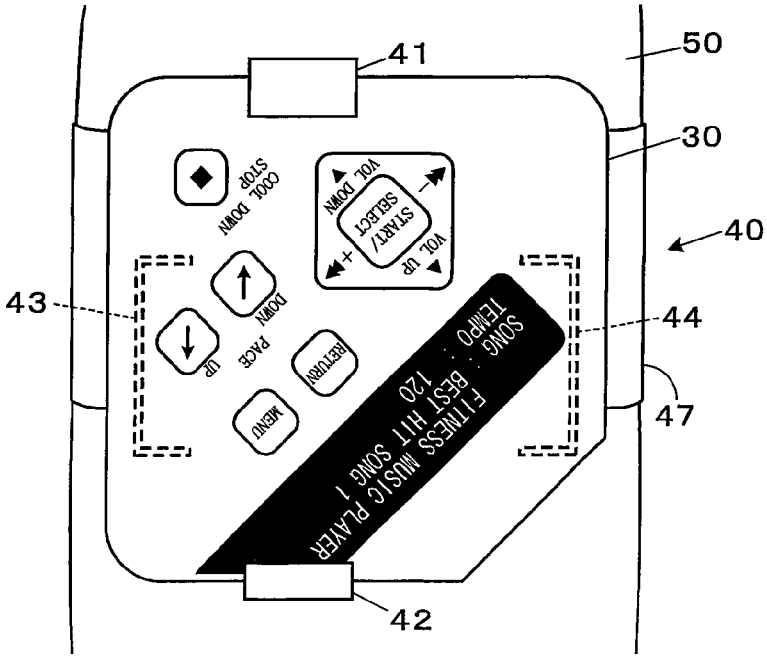
FIG. 15 is a view showing a state where the music player is worn on an arm of a wearer by using the supporter shown in FIG. 14.

FIG. 15 shows a state where a wearer wears the music player on an arm 50 of the wearer by using the supporter 40. The lower side in FIG. 15 is a side closer to an arm root.

Incidentally, the band 47 can be fitted to the supporter 40 only in one direction, but the case 30 can be fitted in the supporter 40 in a state where it is rotated by 90 degrees in the right or left direction from the state shown in FIG. 15. Therefore, in terms of the relation between the case 30 and the band 47, it can be said that the use of the supporter 40 allows the band 47 to be fitted to the case 30 selectively in the two orthogonal directions.

The above structure can also provide the same effects as those of the embodiment described above. In addition, only by changing the direction in which the case 30 is fitted to the supporter 40, it is possible to change the direction in which the band 47 is fitted, without any troublesome work of inserting the band 47 through the through holes. This can enhance convenience in a case where the music player is fitted to the left arm at one time and to the right arm at another time.

Another possible structure is to provide a screw bearing portion in the case of the music player and fix the case to the band with a screw. With this structure, the case can be fixed to the band in a desired direction, and by loosening the screw, the case becomes rotatable relative to the band to be capable of changing its direction.

Therefore, it can be said that, with such a structure, the band can also be fitted selectively in at least two orthogonal directions.

When such a structure is adopted, it is preferable to provide some protective member made of a soft material such as rubber or plastic so that the screw does not in direct contact with the body.

Further, the basic shape of the case (shape assuming that no chamfer is formed) of the music player is not limited to a cuboid shape as described above. The basic shape may be various shapes such as a columnar shape, a four or more-sided polygonal prism shape, and a spheroid shape, and may be any shape, although the preferable shape is a flat shape such that a face of the case facing a limb on which the music player is worn has a larger area than an area of a cross section perpendicular to this face.

Furthermore, a case in a shape other than the flat shape is also applicable. For example, a front surface (a surface where controls and characters are provided) of the case can be a convex surface with a top or ridge at the central portion where menu button 5 and return button 6 are provided in FIG. 1. In this case, the controls can be recognized easily in a state where a person wears the music player on the arm.

Further, to enable more securely fitting between the band and the case, it is preferable that bumps and dips are provided at the band fitting portion and on the back surface of the case which faces the band.

Further, the contents of the processes executed by the CPU 101 of the music player 1 are not limited to those in the embodiment described above.

The example where, for example, music reproduction is performed by automatic performance using MIDI performance data is described here, but with the use of waveform data in an audio format, an MP3 format, and the like, it is also possible to reproduce music at the tempo TP that is set by the processes shown in FIG. 8 according to the state of exercise of the wearer. A concrete reproduction process in such a case, though description thereof will be omitted, may be an appropriate known method.

The number, sizes, shapes, functions, and so on of the controls and the display parts provided in the music player 1 may be any, providing that the arrangement direction of the controls and characters is diagonal to the band.

Further, it goes without saying that the structure and modified structures described hitherto in the embodiment and the modification examples may be freely combined within a range causing no inconsistency.

As is apparent from the above description, the music player of the invention can offer improved operability when worn on a limb.

Therefore, according to the invention, it is possible to provide a music player that is easy to use when worn on a limb.

What is claimed is:

1. A music player that is worn on a limb of a body when in use, comprising:

a case;

a plurality of controls through which instructions relating to music reproduction are given; and a band fitting portion to which a band for attaching the case to the limb is fitted, wherein said case has a chamfer constituted of a plane extending outward from the limb and extending from a face of the case that faces the limb when the music player is worn on the limb, a line of intersection of the plane and the band fitted to said band fitting portion being diagonal to a longitudinal direction of the band, wherein said plural controls are provided on a face, of said case, opposite the face facing the limb, an arrangement direction of said controls being parallel or substantially parallel to the plane constituting the chamfer, wherein the chamfer has an audio output terminal having a connection-insertion direction perpendicular or substantially perpendicular to the plane constituting the chamfer, and wherein the audio output terminal, by its location on the chamfer, is configured to connect to a plug in a manner that prevents the plug from extending beyond a region of space that would be occupied by the case if the chamfer did not exist.

2. The music player according to claim 1, wherein the chamfer has a connection terminal to which an exercise state detection sensor for detecting a state of exercise practiced by a wearer of the music player is connectable.

3. The music player according to claim 1, wherein the arrangement direction of said controls is an arrangement direction of characters written on the face of said case opposite the face facing the limb, the characters being associated with said controls.

4. The music player according to claim 1, wherein said band fitting portion allows the band to be fitted to the case selectively in two orthogonal directions, and wherein the line of intersection of the plane constituting the chamfer and the band is diagonal to the longitudinal direction of the band in whichever of the two directions the band is fitted.

5. The music player according to claim 1, wherein said band fitting portion is attachable/detachable to/from said case.

6. The music player of claim 1, wherein the longitudinal direction of the band is parallel to the face of the case that faces the limb when the music player is worn on the limb.

7. The music player of claim 1, wherein the plane constituting the chamfer and the face of the case that faces the limb when the music player is worn on the limb are or substantially are perpendicular to each other.

8. The music player of claim 1, further comprising the plug, wherein, when the plug is connected to the audio output terminal, the plug does not extend beyond the region of space.

9. The music player of claim 1, wherein the audio output terminal does not protrude from the plane of the chamfer in a direction away from the case.

10. The music player of claim 1, wherein the connection-insertion direction is perpendicular to the plane constituting the chamfer.

11. A music player that is worn on a limb of a body when in use, comprising:

a case;

a plurality of controls through which instructions relating to music reproduction are given; and a band fitting portion to which a band for attaching the case to the limb is fitted, wherein said case has a chamfer constituted of a plane extending outward from the limb and extending from a face of the case that faces the limb when the music player is worn on the limb, a line of intersection of the plane and the band fitted to said band fitting portion being diagonal to a longitudinal direction of the band, wherein said plural controls are provided on a face, of said case, opposite the face facing the limb, an arrangement direction of said controls being parallel or substantially parallel to the plane constituting the chamfer, wherein the chamfer has an audio output terminal having a connection-insertion direction perpendicular or substantially perpendicular to the plane constituting the chamfer, wherein the face of the case that is opposite the face facing the limb is flat, and wherein the audio output terminal, by its location on the chamfer, is configured to connect to a plug in a manner that prevents the plug from extending beyond a region of space that would be occupied by the case if the chamfer did not exist.

12. The music player according to claim 11, wherein the chamfer has a connection terminal to which an exercise state detection sensor for detecting a state of exercise practiced by a wearer of the music player is connectable.

13. The music player according to claim 11, wherein the arrangement direction of said controls is an arrangement direction of characters written on the face of said case opposite the face facing the limb, the characters being associated with said controls.

14. The music player according to claim 11, wherein said band fitting portion allows the band to be fitted to the case selectively in two orthogonal directions, and wherein the line of intersection of the plane constituting the chamfer and the band is diagonal to the longitudinal direction of the band in whichever of the two directions the band is fitted.

15. The music player according to claim 11, wherein said band fitting portion is attachable/detachable to/from said case.

16. The music player of claim 11, wherein the longitudinal direction of the band is parallel to the face of the case that faces the limb when the music player is worn on the limb.

17. The music player of claim 11, wherein the plane constituting the chamfer and the face of the case that faces the limb when the music player is worn on the limb are or substantially are perpendicular to each other.

18. The music player of claim 11, further comprising the plug, wherein, when the plug is connected to the audio output terminal, the plug does not extend beyond the region of space.

19. The music player of claim 11, wherein the audio output terminal does not protrude from the plane of the chamfer in a direction away from the case.

20. The music player of claim 11, wherein the connection-insertion direction is perpendicular to the plane constituting the chamfer.

* * * * *